United States Patent [19]

Saare

[11] Patent Number: 5,048,272

[45] Date of Patent: Sep. 17, 1991

[54] SADDLE RIGGING FOR USE IN SADDLES HAVING RIGID TREES

[76] Inventor: Sharon G. Saare, 1267 Clover Dr., Santa Rosa, Calif. 95401

[21] Appl. No.: 439,437

[22] Filed: Nov. 20, 1989

[51] Int. Cl.[5] ..... B68C 1/02

[52] U.S. Cl. ..... 54/44; 54/46

[58] Field of Search ..... 54/44, 46

[56] References Cited

U.S. PATENT DOCUMENTS

| | | | |
|---|---|---|---|
| 270,270 | 1/1883 | Wilbourn | 54/44 |
| 295,623 | 3/1884 | Frazier | 54/46 |
| 370,266 | 9/1887 | Laughlin et al. | 54/44 |
| 4,287,705 | 9/1981 | Frost et al. | 54/44 |
| 4,506,496 | 3/1985 | Olson | 54/44 |

*Primary Examiner*—Robert P. Swiatek

*Attorney, Agent, or Firm*—Edward L. Miller

[57] ABSTRACT

A saddle is attached to an equine by means of left and right bar straps attached to the left and right bars in the saddle tree. The bars are slotted to receive the stirrup leathers for mounting in the conventional western style. The use of bar straps does not interfere with such mounting of the stirrups, owing to the way in which the bar straps are mounted to the bars. In a preferred embodiment each bar strap starts on the outside of its associated bar and proceeds upward, over the top of the bar and thence downward along the inside of the bar. If the starting point is very near the bottom of the bar a slot in the bar strap aligns with the stirrup slot in the tree. In another embodiment a long length of strap is looped over the top portion of the bar above the slot, with the outer segment of the loop passing through the stirrup slot. The two portions of the loop rejoin each other on the underside of the bar, where the two proceed downward as one. In either embodiment the bottom end of each bar strap is fitted with an optical transition and with a fastener, such as billet straps, to connect to the remaining portion of the rigging. Owing to the length of the bar straps, the location of the fastening to the remainder of the rigging is such that it is not in the vicinity of the knees of a short rider.

14 Claims, 3 Drawing Sheets

SADDLE RIGGING FOR USE IN SADDLES HAVING RIGID TREES

BACKGROUND OF THE INVENTION

The conventional rigging used to attach a so-called "western" saddle, or other type of saddle having a rigid tree, to an equine such as a horse, mule, donkey or burro, can often produce painful discomfort on the inside of the knees of short adult and juvenile riders. This problem arises because of the vertical location of the rigging ring or the rigging plate used in a conventional saddle. In the case of a rigging ring, that location is determined by the length of the support straps that affix the rigging ring to the saddle, and is conventionally either just below the skirt, or perhaps somewhat higher, so that the middle of the ring is approximately even with the bottom of the skirt. In the case of a rigging plate, a portion of the skirt is replaced with an apertured metal plate encased in the rest of the skirt. In either arrangement the cinch portion of the rigging (i.e., the wide belt of material, which frequently is a string girth, that passes under the animal's rib cage) is attached to the upper portion of the saddle with various types of straps called latigos, billets or half-breeds.

Rigging rings and rigging plates are unyielding rigid structures, and the attaching of the latigo or billet creates an increase in thickness, which in conjunction with the rigidity of the rigging ring or rigging plate, is a source of discomfort when repeatedly contacted by the knee of the rider. Such uncomfortable contact results if the leg of the rider is not long enough to let the rider's knee extend beyond the location of the rigging ring or rigging plate. The discomfort results even in those cases where the fender associated with the stirrups is wide enough to cover the rigging ring or rigging plate. The problem is that the attachment is sufficiently rigid and bulky that it may still be felt through the fender. Repeated contact by the knee of a short rider results in eventual discomfort that can in a short time become quite painful.

What is true for the rider is also true for the animal. And while some animals are less sensitive to such irritation than others, in other animals there may occur bruising, and in extreme cases, even scarring, from the pressure caused by the rigging and from the additional pressure caused by the rider's knee against the rigging.

There has been an attempt to avoid this problem of rigging induced discomfort, in a western style saddle, by using an "English" style rigging. In this arrangement a strap extends through the entire saddle, passing over the tree and under the seat. The two ends of this strap extend low enough below the jockey (or perhaps even below the skirt) to be attached to the rest of the rigging. The problem with this approach is that it prevents the use of a western style of mounting the stirrups. A western style of stirrup mounting attaches the stirrups to the tree in a location that is now covered by this English style rigging strap. As a result, it becomes necessary to shift the mounting location of the stirrups forward. The forward location is very close to the forward end of the rigid load spreading bars (the "side pieces" of the tree, as it were) within the saddle. Thus, any downward force applied to this point (as communicated by the stirrups when the rider is leaning forward or standing) is *not* distributed over the length of each bar. Instead, it is felt in its entirety at that forward location. This puts additional pressure on the horse at a place in its anatonomy that already experiences a lot of pressure to begin with. Experience has shown that this English style of rigging and stirrup mounting cannot be used with some horses.

There is yet another reason why the solution set out in the preceding paragraph is less than ideal. Even if mounting the stirrups in the forward mounting location were free of the problem of undistributed extra pressure, it would still be the case that it is better for the overall balance of the rider to leave the stirrups attached in their traditional location for a western saddle. Thus, what is desired is a new way of rigging a western style saddle that does not disturb the mounting position for the fenders and stirrups.

SUMMARY OF THE INVENTION

The problem of discomfort caused by the conventional attachment of the rigging may be solved by using a rigging attachment that is not rigid while also remaining compatible with the use of western style stirrups. It may also be desirable to move the location of the rigging attachment downward. Such a compatible non-rigid attachment for the rigging may be achieved by replacing the rigging ring or rigging plate with "bar straps", perhaps of nylon, which originate on the top outer sides of the bars, run over the top of the bars onto the inner sides of the bars, continue downwards and finally out under the bars beneath the location where the stirrup leathers attach to the tree.

The lower end of the bar strap, which may be if desired be several inches lower than any conventional rigging ring, may terminate in a plurality of billet straps. In the case where the bar strap is both long enough and sufficiently non-abrasive, it may be desirable to form the billet straps directly out of one end of the bar strap; that is, both are a part of the same unit of material. Alternatively, a transition of leather or other suitable material may be sewn or otherwise attached to the lower end of the bar strap. The transition also serves as a protective sleeve. The transition may be of a U- or J-shape, and can prevent difficult-to-replace sections of the saddle from being abraded by a nylon webbing and the seared end of that webbing. The transition can also serve to conceal the nylon webbing. In this style of construction the billet straps are sewn or otherwise attached to the transition.

It will be understood that the particular type of fastener used at the lower end of the bar strap is somewhat a matter of choice, billet straps being the preferred type. Other suitable fasteners could be used as well.

In yet another embodiment the bar strap may be attached to the bar by looping a length of webbing over the portion of the bar that is above a slot in the bar used to hang the stirrups, with the outer portion of the loop (i.e., the portion furthest from the animal) passing through the slot. After passing through the slot it adjoins the the other end of the loop to form a double thickness of webbing that travels down to the transition, which is as previously described.

BRIEF DESCRIPTION OF THE DRAWINGS

The invention to be described herein may be best understood with reference to the figures, wherein.

DESCRIPTION OF A PREFERRED EMBODIMENT

Figure 1A:
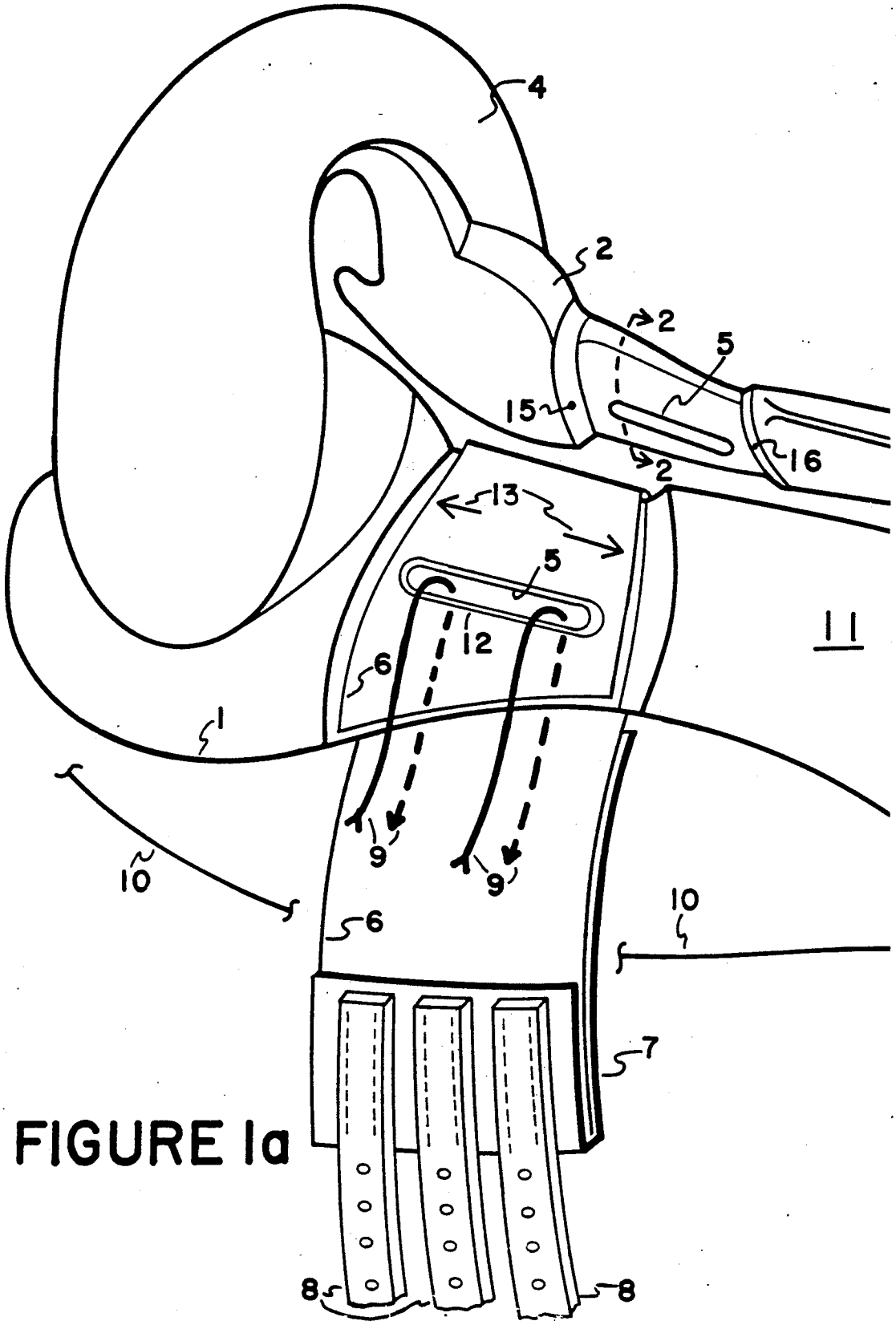
FIGS. 1*a–b* are respective perspective views of front and rear portions of a saddle tree and a bar strap for rigging a saddle to be used upon an equine.
Figure 1B:
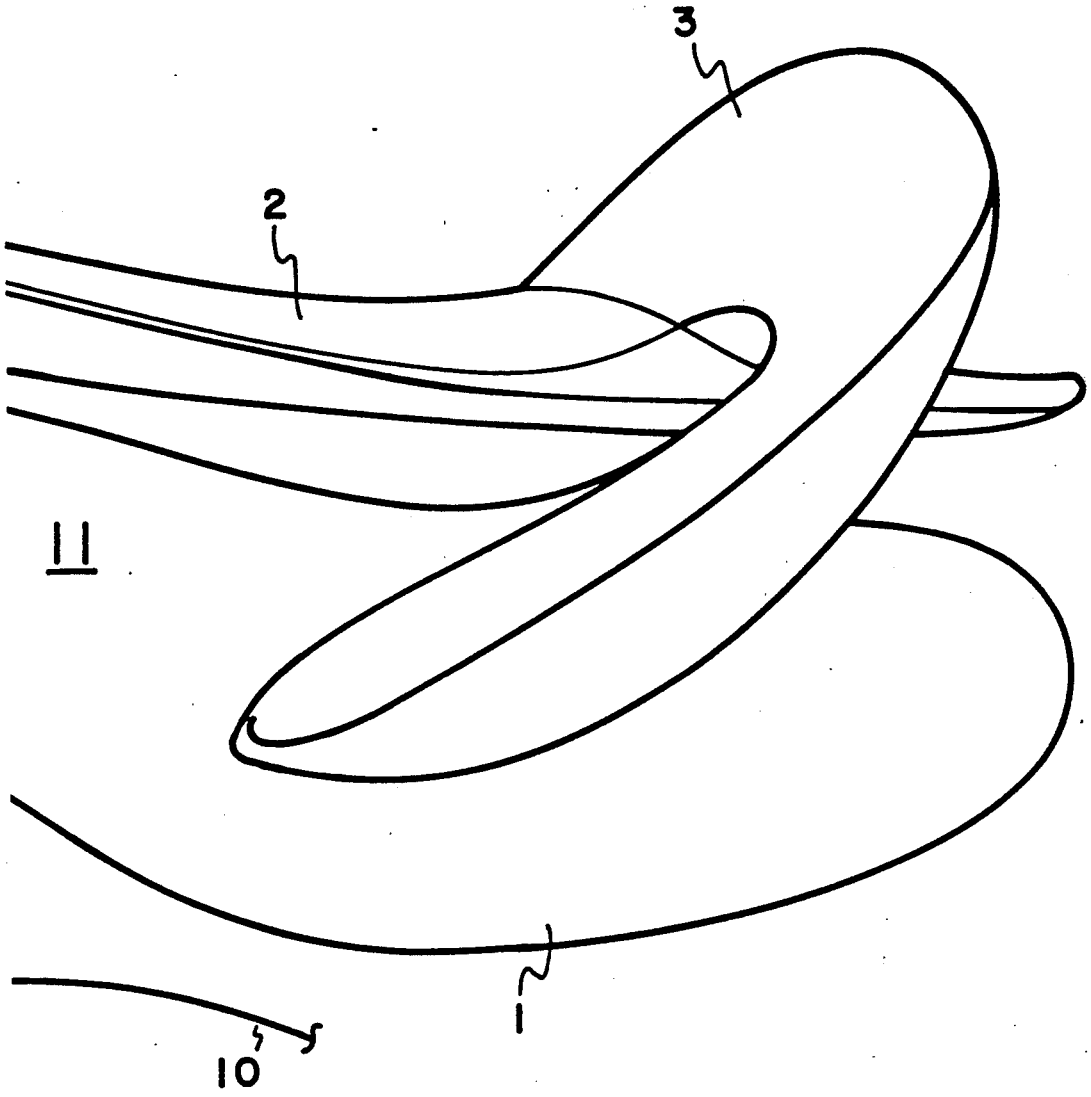

Refer now to FIGS. 1*a–b*, wherein is shown a saddle tree 11 constructed in accordance with the invention. In a preferred embodiment saddle tree 11 is constructed from four separate pieces: left bar 1, right bar 2, cantle 3 and fork 4, each of which are made from yellow pine and fastened together by suitable means (e.g., glue, nails and staples). The tree 11 serves as the foundation upon which the rest of the saddle is constructed. For the sake of simplicity the views afforded in FIGS. 1*a–b* restrict themselves to the tree 11 and certain other features closely related to the invention.

Once the cantle 3 and fork 4 are assembled to the two bars (1, 2) the tree 11 is preferably coated with fiberglass. It will be apparent to those skilled in the art that a unitary type of construction could also be employed to produce the tree, and still cooperate with the invention. For example, the saddle tree 11 could be a molded part made of a suitable plastic.

The left and right bars (1, 2) each have therein a slot 5 to receive stirrup leathers (not themselves shown). The path that is taken by the stirrup leathers is, however, indicated by the heavy arrows 9.

Associated with each bar 1 and 2 is a respective bar strap 6. For the sake of simplicity only the left bar strap 6 associated with left bar 1 is shown in the Figure. In a preferred embodiment the bar straps are made of a webbing, with nylon being the material of choice. Notice how left bar strap 6 begins at the lower outside edge of the left bar 1 and proceeds upward along the outside thereof, passing over the top of the left bar 1 and thence downward along the inside thereof. A slot 12 in left bar strap 6 aligns with slot 5 in the bar 1 to allow passage of the stirrup leathers. It be understood that a right bar strap (not shown, but similar to left bar strap 6) is similarly attached to the right bar 2.

In a preferred embodiment the bar straps are of nylon webbing approximately three to four inches wide, and approximately from a sixteenth to an eight of an inch in thickness. The bar straps may be fastened to the bars by any suitable means, including glue, nails and staples.

In an alternate embodiment it may be desirable to use bar straps that begin on the outside of the bars above the slots 5, as indicated by arrows 13. In such an embodiment slot 12 in the bar strap would not be needed, since the strap would not extend over the slot 5, but would instead end somewhere above it.

Now consider the other end of bar strap 6. It extends downward some distance, the amount of which is a matter of choice, provided it is at least long enough. As illustrated in FIGS. 1*a–b* it extends to a point lower than the lower extent of the skirt (line 10 indicates the lower edge of the skirt, which is not itself shown). Another choice would be for the bar strap 6 to end about even with the skirt. In either case it will be understood that the bar straps lie on top of the skirt, but under the stirrup leathers, which are in turn under the jockey (not shown).

Attached to the lower end of bar strap 6 is a transition 7, preferably made of leather. As shown in the figure, the transition is in shape of a "J" with the longer of the two legs on the underside. One purpose of the transition 7 is to protect the skirt from abrasion caused by the nylon bar strap 6. Another purpose is to conceal the nylon webbing and thus provide a more esthetically pleasing appearance. The lengths of the legs of the transition 7 may be affected by how far down the bar strap 6 extends. For example, if the bar strap 6 is short, and extends downward only to the vicinity of the skirt, the transition 7 may be more of a "U" shape having legs of equal length. However, the longer the bar strap extends, the longer the inner leg of the transition, so that it may protect the skirt. The outer leg may also get longer, although perhaps not by as much, in order to still conceal the webbing after it emerges from under the jockey.

Attached to the outer portion of the transition 7 are a plurality of billet straps 8, preferably of leather. The remaining portion of the rigging attaches to these billet straps 8, and secures the saddle to the animal in the usual way. And although billet straps are preferred, other means of fastening can be employed.

It can now be appreciated that the rigging arrangement described above will eliminate any contribution by the rigging to sore knees in the rider. The bar strap 6 is non-rigid and yields to the pressure of contact, unlike a rigging ring or a rigging plate. Not only is the bar strap flexible, but it is also thinner than rigging rings and rigging plates. Furthermore, the bar straps can be made long enough that the fasteners (billet straps or whatever) used to connect to the remaining portion of the rigging (say, a string girth) are indeed low enough that they are in a location completely different than the rider's knees.

Figure 2:
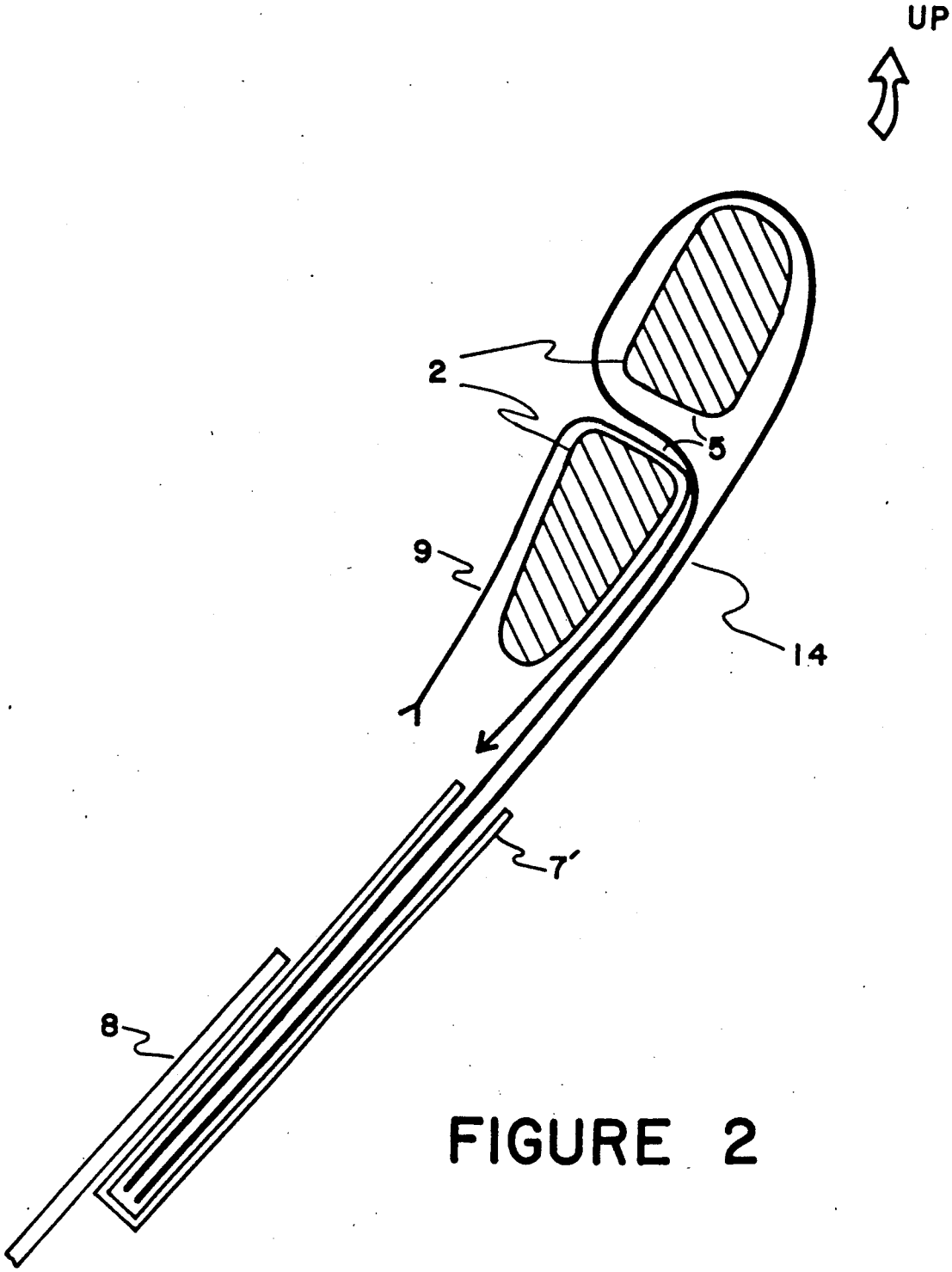
FIG. 2 is a sectional view of an alternate way attaching the bar strap of FIG. 1 to the saddle tree.

Refer now to FIG. 2, which is a sectional view of the right-hand bar 2 of the saddle tree 11 of FIGS. 1*a–b*. Note that a length of strap 14 begins at a transition 7' (corresponding to 7 of FIGS. 1*a–b*, except that it has portions of equal length) and runs upward to loop around the top portion of the bar 2. As before, the heavy arrow 9 indicates the path of the stirrup leathers, which continue to mount as shown in FIG. 1. The difference in FIG. 2 is that since the bar strap 14 loops around the bar 2, it need not also be fastened to it, although that can be also, if desired.

Now return briefly to FIGS. 1*a–b*. Notice that there is a recess between shoulders 15 and 16 on the inside of the right-hand bar 2. A similar recess (not visible) exists on the inside portion of the left-hand bar 1. The function of the recess is to receive in one location the bar strap (6, 14), receive in another location the bar strap and the stirrup leathers, and still allow the inner surface of the tree contacting the animal (through the pad, which is not shown) to be relatively smooth. To this end, the recess may be of differing depths along its length.

I claim:

1. A saddle comprising:

a saddle tree, itself comprising:

a left bar having first and second surfaces and a front and a rear;

a right bar, spaced apart from the left bar, and having first and second surfaces and a front and a rear;

the first surfaces of the left and right bars generally facing toward each other, and the second surfaces thereof generally facing away from each other; and there being a slot in the left bar and a slot in the right bar;

a left bar strap fastened at a first end thereof to the left bar at a location adjacent the slot therein and on the second surface thereof, an unfastened portion of the left bar strap extending around to the first surface of the left bar in a counter clockwise direction when viewed in a direction proceeding from the front of the left bar to the rear thereof;

left fastening means, attached to a second end of the left bar strap, for fastening to one end of rigging that secures the saddle to an equine or the like;

a right bar strap fastened at a first end thereof to the right bar at a location adjacent the slot therein and on the second surface thereof, an unfastened portion of the right bar strap extending around to the first surface of the right bar in a clockwise direction when viewed in a direction proceeding from the front of the right bar to the rear thereof; and right fastening means, attached to a second end of the right bar strap, for fastening to a remaining end of the rigging.

2. A saddle as in claim 1 wherein the left and right bar straps are each made of a webbing.

3. A saddle as in claim 2 wherein the webbings are nylon.

4. A saddle as in claim 1 wherein the left and right bar straps each include a hole proximate the respective second surfaces of the left and right bars, of the same general shape as, and in alignment with, the slots therein.

5. A saddle as in claim 1 wherein the left and right bars include recesses in the first surfaces thereof, the recesses respectively receiving the left and right bar straps, the depth of those recesses being approximately the thickness of those left and right bar straps.

6. A saddle as in claim 1 further comprising left and right transition means respectively between the second ends of the left and right bar straps and the left and right fastening means, each transition means being bent to have first and second parallel portions that wrap around the second end of the respective bar strap.

7. A saddle as in claim 6 wherein the first and second parallel portions are of equal length.

8. A saddle as in claim 6 wherein the first and second parallel portions are of unequal length, the longer of the two portions being closest to the equine when the saddle is mounted thereto.

9. A saddle as in claim 6 wherein the left and right transition means are made of leather.

10. A saddle as in claim 1 wherein the left and right fastening means comprise billet straps.

11. A saddle comprising:

a saddle tree, itself comprising:

a left bar having first and second surfaces;

a right bar, spaced apart from the left bar, and having first and second surfaces;

the first surfaces of the left and right bars generally facing toward each other, and the second surfaces thereof generally facing away from each other; and there being a slot in the left bar and a slot in the right bar;

a left bar strap looped at approximately the middle thereof around an upper portion of the left bar above the slot therein, and thereafter forming a left bar strap of double thickness proximate the first surface of the left bar and extending therebeyond to a distal end of the left bar strap;

left fastening means, attached to the distal end of the left bar strap, for fastening to one end of rigging that secures the saddle to an equine or the like;

a right bar strap looped at approximately the middle thereof around an upper portion of the right bar above the slot therein, and thereafter forming a right bar strap of double thickness proximate the first surface of the right bar and extending therebeyond to a distal end of the right bar strap;

right fastening means, attached to the distal end of the right bar strap, for fastening to a remaining end of the rigging; and left and right transition means respectively between the distal ends of the left and right bar straps and the left and right fastening means, each transition means being bent to have first and second parallel portions that wrap around the distal end of the respective bar strap.

12. A saddle as in claim 11 wherein the first and second parallel portions are of equal length.

13. A saddle as in claim 11 wherein the first and second parallel portions are of unequal length, the longer of the two portions being closest to the equine when the saddle is mounted thereto.

14. A saddle as in claim 11 wherein the left and right transition means are made of leather.

* * * * *